United States Patent [19]

Iwase

[11] Patent Number: 4,468,867

[45] Date of Patent: Sep. 4, 1984

[54] DRYING APPARATUS

[75] Inventor: Satoru Iwase, Okazaki, Japan

[73] Assignee: Tokyo Shibaura Denki Kabushiki Kaisha, Kawasaki, Japan

[21] Appl. No.: 324,151

[22] Filed: Nov. 23, 1981

[30] Foreign Application Priority Data

Feb. 27, 1981 [JP] Japan ..... 56-28915

[51] Int. Cl.[3] ..... F26B 11/02

[52] U.S. Cl. ..... 34/82; 34/133

[58] Field of Search ..... 34/133, 82; 432/105, 432/107

[56] References Cited

U.S. PATENT DOCUMENTS

| | | | |
|---|---|---|---|
| 2,807,889 | 10/1957 | Dunkelman | 34/133 |
| 2,865,111 | 12/1958 | Geldhof | 34/133 |
| 3,378,934 | 4/1968 | Erickson | 34/82 |
| 3,722,106 | 3/1973 | Takeyama et al. | 34/133 |

FOREIGN PATENT DOCUMENTS

| | | | |
|---|---|---|---|
| 221343 | 3/1968 | United Kingdom | 34/133 |

*Primary Examiner*—Larry I. Schwartz
*Assistant Examiner*—David W. Westphal
*Attorney, Agent, or Firm*—Schwartz, Jeffery, Schwaab, Mack, Blumenthal & Koch

[57] ABSTRACT

A drying apparatus includes a cabinet, an open-ended drum having a horizontal axis disposed eccentrically inside of the cabinet so that an air path is defined between the wall of the cabinet and the peripheral surface of the drum, an opening with a door disposed in the central portion of the front panel of the cabinet and faced toward the open-end of the drum, an air inlet port provided on one side of the front panel communicating with the air path, an exhaust port provided on the other side of the front panel and communicating with the interior of the drum, and means housed in the cabinet for supplying hot air into the interior of the drum.

19 Claims, 4 Drawing Figures

DRYING APPARATUS

BACKGROUND OF THE INVENTION

The present invention relates to a drying apparatus and more particularly to an improvement of a drying apparatus having an open-ended drum supported rotatably about a horizontal axis.

In conventional types of drying apparatus, an air inlet port having a filter is provided, for instance, in the front part or panel of the cabinet, while an exhaust port having a filter is provided at the central portion of the rear wall of the open-ended rotatable drum. The filter in the air inlet port catches any dust in the air which is introduced through an air inlet port, and the filter in the exhaust port catches any lint contained in the exhaust air. With such a construction, however, although the inspection and cleaning of the air inlet portion can be carried out easily, inspection and cleaning of the filter in the exhaust port are difficult because in its rearward position of the drum it is hardly accessible.

Recently, a construction has been proposed (but does not form part of the prior art) wherein the air inlet port with its filter and the exhaust port with its filter are both provided in the front part or panel of the cabinet at a position adjacent to the door on both sides thereof for facilitating the inspection and cleaning operation. In this case, the air inlet port communicates with an air path defined between the side wall of the cabinet and a peripheral surface of the drum, while the exhaust port communicates with the interior of the same drum. It is desirable from the viewpoint of operational convenience that the opening for placing materials or clothes into the drum and taking them out is disposed at a central position of the front portion or panel of the cabinet.

Thus, considering an ordinary arrangement having the center of rotation of the drum coincident with the center of the opening, i.e., the door, if the diameter of a front opening portion or open-end of the drum is increased and the area of the exhaust port facing the front opening portion of the drum is also increased for improving the air exhausting efficiency, the area of the air inlet port facing the air path defined between the side wall of the cabinet and the peripheral surface of the drum is reduced, thereby reducing the efficiency of the air induction operation. Conversely, if the diameter of the front opening portion of the drum is reduced and the area of the exhaust port facing the front opening portion of the drum is increased for improving the efficiency of the air induction operation, the area of the exhaust port facing the front opening portion of the drum is reduced, thereby reducing the exhausting efficiency. In either of these cases, a desired amount of ventilation cannot be attained, and the internal temperature of the drum rises up excessively, causing disadvantages such as discoloration of the materials being dried, or thermal deformation of any of the parts of the apparatus which are made of a plastic material.

SUMMARY OF THE INVENTION

Therefore, it is an object of the present invention to provide a novel and improved drying apparatus which has an open-ended drum supported rotatably about a horizontal axis.

It is another object of the invention to provide such a drying apparatus in which an air inlet port and an exhaust port are provided on its front panel.

It is further another object of the invention to provide a novel and compact drying apparatus in which the drum is arranged at an eccentric position in the cabinet.

It is still another object of the invention to provide a drying apparatus including an air inlet port and an exhaust port, each provided with a filter, which can be easily inspected, and if the filters are clogged by dust or lint, can be cleaned by the operator.

In accomplishing the foregoing objects, there has been provided according to the invention a drying apparatus comprising a cabinet having a front panel and side walls, an open-ended drum having a horizontal axis disposed eccentrically inside of the cabinet, thereby defining an air path between at least one of the walls and the peripheral surface of the drum, support means for rotatably supporting the drum, drive means for rotating the drum, an opening disposed in the center of the front panel and facing the open-end of the drum for loading and unloading the drum, a door operable for opening and closing the opening, an air inlet port having an induction opening provided in a first portion of the front panel, and communicating with the air path, an exhaust port having an exhaust opening provided in a second portion of the front panel on the opposite side of the opening from the first portion and communicating with the interior of the drum, and means housed in the cabinet for supplying hot air into the interior of the drum.

Other objects, features and attendant advantages of the invention will become readily apparent as the apparatus becomes better understood by reference to the following detailed description of preferred embodiments, when considered in connection with the accompanying drawings.

BRIEF DESCRIPTION OF THE DRAWINGS

In the drawings, forming a part hereof, in which like reference characters denote like parts in the various views.

DETAILED DESCRIPTION OF PREFERRED EMBODIMENTS

Figure 1:
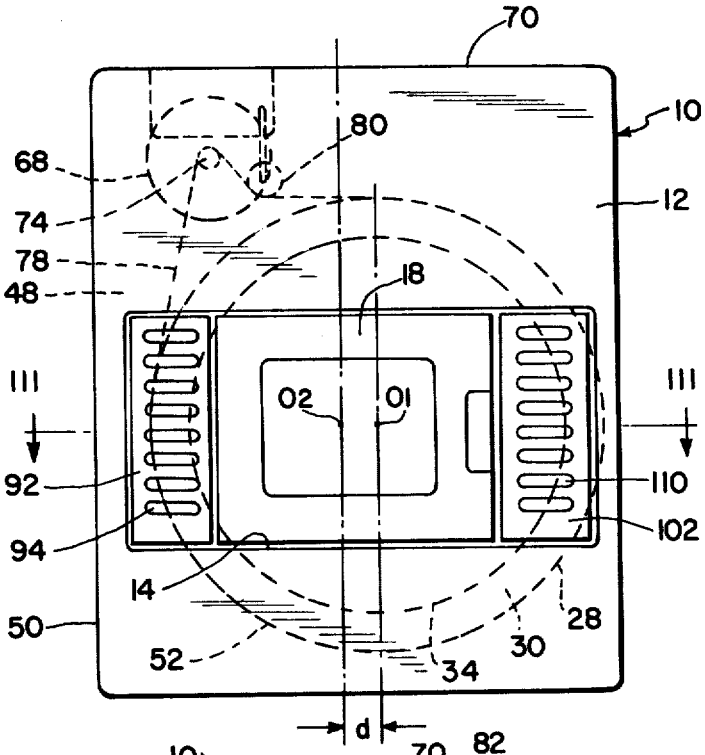
FIG. 1 is a front view of a drying apparatus according to a preferred embodiment of the invention, showing the drum and drive assembly in broken lines.

Now there will be described a preferred embodiment of the invention according to FIGS. 1 through 4.

Numeral 10 designates a cabinet having a front panel 12 formed with a horizontally elongated rectangular recessed portion 14 at the center. An opening 16 of a rectangular configuration is provided through a central part of the recessed portion 14. A door 18 is hingedly attached to the front panel 12 and is horizontally swingable to open and close the opening 16. A drum supporting plate 20 is fixedly secured to the inside surface of the front panel 12 along the periphery of the opening 16, and has a drum supporting portion 22 of a short cylindrical configuration at the periphery. A rectangular opening 24 is formed through the drum supporting plate 20 at a position displaced leftwardly by a distance d from the center $O_1$ of the drum supporting portion 22 in FIGS. 1 and 3. The opening 24 of the drum supporting plate 20 is placed in alignment with the opening 16 through a seal member 26 interposed therebetween.

A substantially cylindrical drum or an open-ended drum 28 is provided with a front annular plate 30 having a short cylindrical projection 32 with a forward bearing portion 34 in its inner periphery functioning as the open-end of the drum 28. The drum 28 is supported via the projection 32 by the outer periphery of the drum supporting portion 22 through a bearing member 36. The drum 28 is further provided with a closed (but not in the sense to exclude apertures therethrough) rear end wall 38 having a horizontal shaft 40 projecting rearwardly from the center of the end wall 38. The shaft 40 is supported freely rotatably by a bearing 42 secured to a drum supporting frame 44, which in turn is secured to the rear portion 46 of the cabinet 10 in a horizontally bridging manner. As a result, the center $O_1$ of the drum supporting portion 22, that is, the center of the drum 28 is displaced rightwardly by a distance d from the center $O_2$ of the opening 16 or the door 18 in FIGS. 1 and 3. In other words, the drum 28 is disposed eccentrically in the cabinet 10 to form an air path 48 between the side wall 50 of the cabinet 10 and the peripheral surface 52 of the drum 28. A rising portion 54 having an annular shape is formed by bending out of the drum supporting plate 20 in a manner surrounding the drum supporting portion 22. A seal member 56 is attached to the rising portion 54 so that one end of the seal member 56 slidingly contacts with the front surface of the annular plate 30 of the drum 28.

An air distributing member 58 of a circular dish shape having a number of holes 60 is secured to the drum supporting frame 44 to form an air distributing space 62 surrounding the shaft 40. A seal 64 provided on the outer periphery of the member 58 is brought into sliding contact with the rear end wall 38 of the drum 28. A number of through holes 66 are provided through the rear end wall 38 for communicating the interior of the drum 28 with the air distributing space 62.

An electric motor 68, as the drive means for rotating the drum 28, is secured to top wall 70 of the cabinet 10 at an upper-left position. The motor 68 is directly coupled to an extension shaft 72 having a portion operable as a pulley 74. A fan 76 is directly coupled to one end of the extension shaft 72. A belt 78 is extended around the pulley portion 74 and around the periphery of the drum 28, and a tension pulley 80 applies a tension to the belt 78. Reference numeral 82 designates a fan casing which covers the fan 76. A duct 84 connected with the delivering port of the fan casing 82 is extended to the rear side of the air distributing member 58. The duct 84 has a number of holes 86 corresponding to the holes 60 of the air distributing member 58. Within the duct 84, there is provided an electric heater 88 to heat air delivered from the fan 76, the fan 76 and the heater 88 constituting in combination a hot air producing means.

An induction opening 90 of an air inlet port 92 is provided in the recessed portion 14 of the front panel 12 on the left side of the door 18. The induction opening 90 is located outwardly of the rising portion 54 of the drum supporting plate 20, and communicates with the air path 48 in the interior of the cabinet 10. An induction filter portion 94 provided with a filter frame 96 of a rectangular shape and a filter member 98 is mounted in the recessed portion 14 to cover the front end of the induction opening 90. An exhaust opening 100 of an exhaust port 102 is provided in the recessed portion 14 of the front panel 12 on the right side of the door 18. The exhaust opening 100 is located internally of the drum supporting portion 22 of the drum supporting plate 20. A number of ventilation holes 104 acting as air exhausting holes are provided through the drum supporting plate 20 at a portion opposing to the exhaust opening 100, so that the latter is in communication through the holes 86 with the internal space or the interior of the drum 28.

Figure 4:
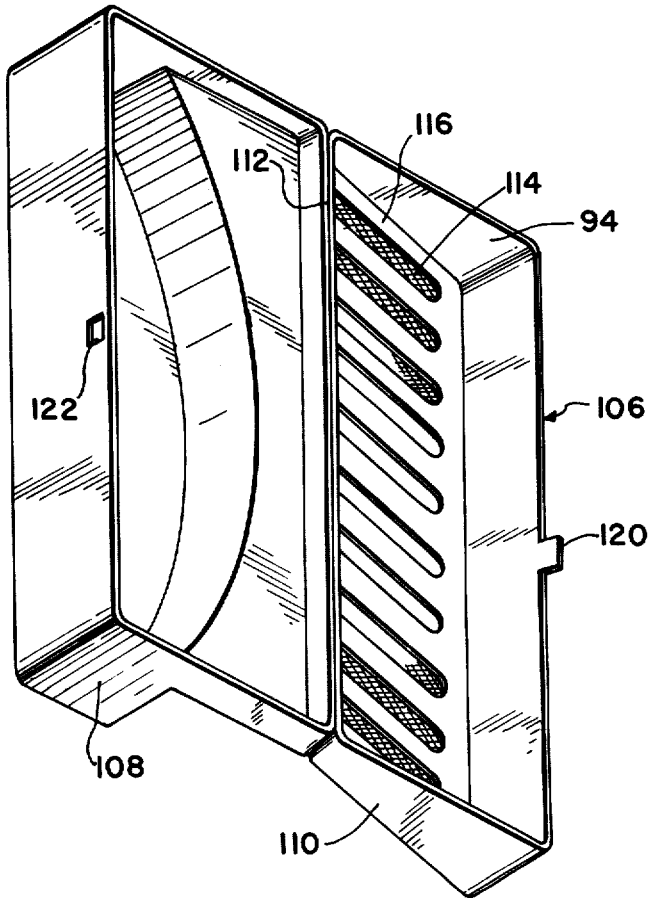
FIG. 4 is a perspective view showing a unit of an exhaust sleeve portion and an exhaust filter portion according to the invention.

Numeral 106 designates a unit having an exhaust sleeve portion 108 and an exhaust filter portion 110, which can be detachably mounted or openably hinged on the sleeve portion 108 as seen in FIG. 4. The unit 106 may be made of a plastic material and formed into an integral unit comprising the exhaust sleeve portion 108 and an exhaust filter portion 110 connected together through a thin integral hinge portion 112. The exhaust sleeve portion 108 is mounted by screws (not shown) on the right side of the door 18, fitting into the exhaust opening 100. The sleeve portion 108 projects rearwardly from the exhaust opening 100 to abut against the front surface of the drum supporting plate 20, while the exhaust filter portion 110 comprises a filter member 114 having a number of meshes formed integrally with a frame 116. A seal 118 is secured to the periphery of the exhaust sleeve portion 108. The edge portion of the left side wall of the frame 116 in FIG. 4 is formed into the thin integral hinge portion 112, as described above. When a clamp member 120 projecting from the right side wall of the frame 116 is detachably inserted into a hole 122 provided in the sleeve portion 108, the two portions 108 and 110 form the unit 106 and are assembled together into the front panel 12. Therefore, as a result of this construction, the exhaust filter portion 110 is mounted detachably on the front panel 12. The front surfaces of the induction filter portion 94 and the exhaust filter portion 110 are both tapered rearwardly in directions facing away from the door 18.

A cover plate 124 closes the rear side of the cabinet 10.

The operation of this embodiment of the present invention will now be described:

With materials to be dried put into the drum 28 through the opening 16, a start switch (not shown) is operated after a timer switch (not shown) is set.

Figure 2:
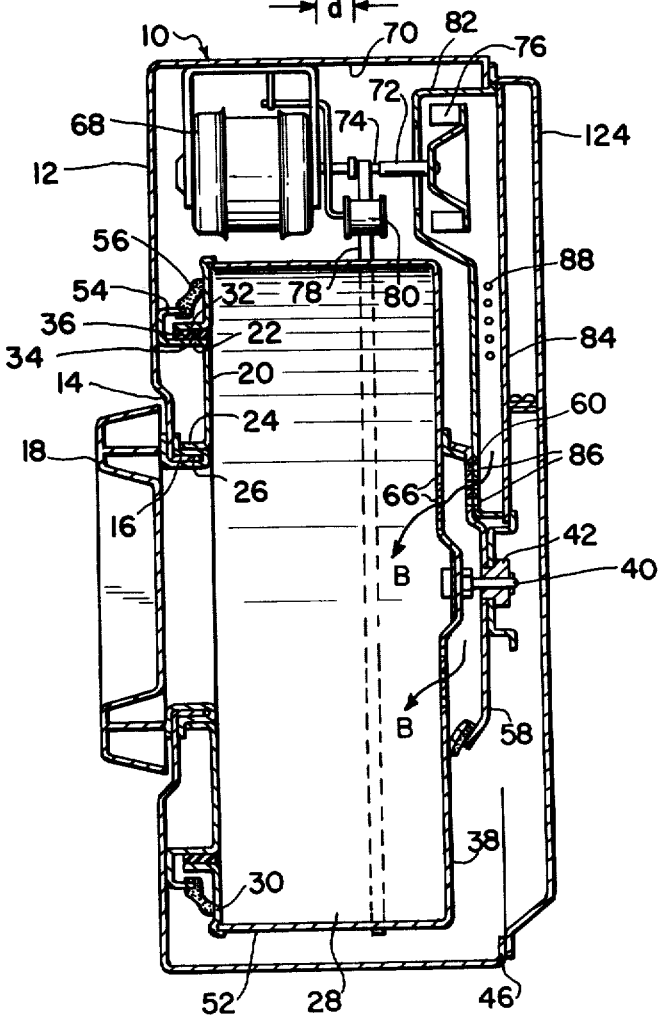
FIG. 2 is a vertical cross-sectional view taken from front to back of the drying apparatus according to the invention.
Figure 3:
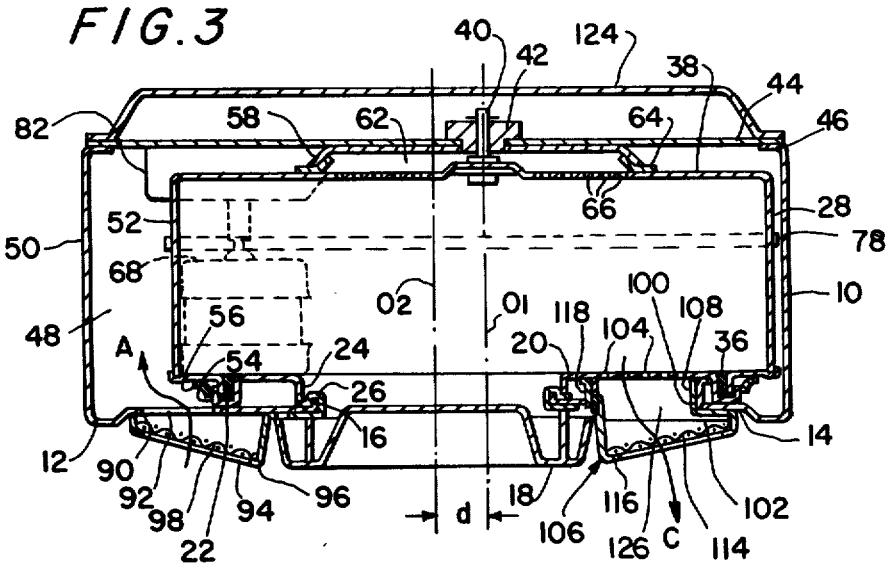
FIG. 3 is a horizontal cross-sectional view taken generally along the line III—III in FIG. 1.

Upon energization of the electric motor 68 and the electric heater 88, the fan 76 rotates, and the belt 78 drives the drum 28. Heater 88 starts to generate heat. Air outside of the drying apparatus is inducted through the induction filter portion 94 and the induction opening 90 into the cabinet 10. Air thus entering the cabinet 10 flows through the left portion along the periphery of the drum 28, i.e., through the air path 48, as indicated by an arrow marked A in FIG. 3, and enters the fan casing 82 and then the duct 84 to be heated by the heater 88. Hot air then flows, as shown in FIG. 2 by an arrow marked B, through holes 86 and holes 60 into the air distributing space 62 and then through the holes 66 into the interior of the drum 28, which is now rotating. In the drum 28, hot air deprives materials to be dried of water, and the water-laden hot air is then passed through ventilation holes 104, the exhaust sleeve portion 108, i.e., the exhaust opening 100 and the exhaust filter portion 110, to the outside of the cabinet 10, as shown in FIG. 3 by arrow marked C. The drying operation of the drying apparatus is thus accomplished.

The inner surface of the drum supporting plate 20 acts as a fixed wall in opposition to the rear end wall 38 of the drum 28, to prevent materials in the drum 28 from dropping out of the interior of the drum 28 during the drying operation.

Since the front surface of the exhaust port 102 or the exhaust filter portion 110 is tapered rearwardly in the direction facing away from the door 18, exhaust port 102 has an exhaust path 126 such that its exhaust air departs from the front area of the door 18.

During the operation, any dust contained in the air introduced through the induction opening 90 is caught by the induction filter portion 94, forming a deposit on the front surface of the filter member 98. On the other hand, any lint contained in the exhaust air is caught by the exhaust filter member 114, to be deposited on the rear surface of the same member 114.

Since the induction filter portion 94 and the exhaust filter portion 110 are provided on the front panel 12 of the cabinet 10, at positions on both sides of the door 18 located at the center of the front panel 12, it is made possible to access these filter portions 94 and 110 from the front side of the cabinet 10, and therefore the inspection of the induction filter portion 94 and the exhaust filter portion 110 to see if they are clogged by dust or lint as well as the cleaning of the filter members 98 and 114 are greatly facilitated. To clean the filter member 114, the exhaust filter portion 110 is opened by releasing its clamp member 120 from the hole 122 of the sleeve portion 108, and then the dust and lint inside the filter member 114 are removed.

Furthermore, since the induction filter portion 94 and the exhaust filter portion 114 are both on the front panel 12 of the cabinet 10 at positions easily observable by the operator, any possibility of forgetting this inspection and cleaning can be substantially eliminated.

In addition, since the center of rotation $O_1$ of the drum 28 is shifted rightwardly from the center $O_2$ of the opening 16 and door 18 by a distance d toward the exhaust opening 100, namely, the drum 28 is positioned eccentrically in the cabinet 10 to cause a wide separation of the peripheral surface of the drum from the internal surface of the side wall of the cabinet 10, it is made possible to provide a wide area as the air path 48 for the induction opening 90 leading into the cabinet 10, and air passing through the induction opening 90 is allowed to flow into the fan 76 far more easily than in the conventional construction. As a result of eccentrically positioning the drum 28 in the cabinet 10, a wide area can be assigned to the ventilation holes 104, namely, the exhaust opening 100 for communication with the interior of the drum 28, and the resistance of the exhaust air can thereby be reduced.

According to one preferred embodiment, the electric motor 68 is provided in the leftward part of the cabinet 10 in FIG. 1, in the air path 48 generally opposite to the induction opening 90, and therefore the cooling effect for the motor 68 can thereby be improved.

It is, of course, possible to position the drum 28 eccentrically in the upper part of the cabinet 10, in order to make the air path on the lower side of the cabinet 10. In this case, the induction opening 90 and the exhaust opening 100 are respectively provided on the upper side and lower side of the door 18 on the front panel 12.

What is claimed is:

1. A drying apparatus, comprising:

a cabinet having a front panel and enclosing walls including at least top and side walls;

a drum having one open end and one closed end and having a horizontal axis disposed eccentrically inside of said cabinet, said closed end having through holes whereby an air path to said through holes is defined between one of said walls and the peripheral surface of said drum;

support means for rotatably supporting said drum inside said cabinet;

drive means for rotating said drum;

an opening disposed in the center of said front panel facing said open end of said drum for loading and unloading said drum;

a door operable for opening and closing said opening;

an air inlet port having an induction opening provided at a first portion of said front panel on one side of said opening in the center of said front panel and communicating with said air path;

an exhaust port having an exhaust opening having an exhaust opening provided at a second portion of said front panel, said exhaust port being positioned in alignment with at least a portion of said open end, said exhaust port also being off center relative to said drum and communicating with the interior of said drum directly through said open end of said drum, said exhaust port being positioned on the side of said opening opposite to said air inlet port; and means housed in said cabinet for supplying hot air into the interior of said drum from air in said air path.

2. A drying apparatus according to claim 1, wherein said air inlet port includes a filter for filtering air.

3. A drying apparatus according to claim 1, wherein said exhaust port includes a filter for filtering exhausted air.

4. A drying apparatus according to claim 1, wherein said exhaust port includes means for directing exhausted air away from the front of said door.

5. A drying apparatus according to claim 3, wherein said exhaust port filter includes a filter frame detachably mounted on said front panel and a filter member mounted on said filter frame.

6. A drying apparatus according to claim 1, wherein said exhaust port includes a sleeve portion which fits into said exhaust opening.

7. A drying apparatus according to claim 1, wherein said exhaust port includes a sleeve portion which fits into said exhaust opening and a filter detachably mounted on said sleeve portion.

8. A drying apparatus according to claim 7, wherein said sleeve portion and said filter are made of plastic and are connected through a thin integral hinge, so that said filter is openable with respect to said sleeve portion.

9. A drying apparatus according to claim 8, wherein said filter and said sleeve portion include clamp means for fastening said filter to said sleeve portion.

10. A drying apparatus according to claim 1, wherein said drive means comprises an electric motor, a pulley driven by said electric motor, and a belt extended around said pulley and around the periphery of said drum.

11. A drying apparatus according to claim 10, wherein said electric motor is disposed on the same side of said cabinet as said air path.

12. A drying apparatus according to claim 1, wherein said drum further comprises a shaft projecting rearwardly from the center of its closed end wall, an annular plate provided at the open end of the drum, and a bearing portion formed at the inner periphery of said annular plate, and said supporting means comprises a bearing supported in the rear portion of said cabinet for supporting said shaft and a supporting plate attached to said front panel and having a drum supporting portion for supporting said bearing portion.

13. A drying apparatus according to claim 12, wherein said supporting plate includes an opening placed in alignment with said opening disposed in the center of said front panel.

14. A drying apparatus according to claim 13, wherein said supporting plate includes holes for providing communication between said exhaust port and the interior of said drum.

15. A drying apparatus according to claim 13, wherein said supporting plate includes holes positioned opposite to said exhaust opening for providing communication between said exhaust port and the interior of said drum.

16. A drying apparatus according to claim 1, wherein said means for supplying hot air to the interior of said drum comprises a fan driven by said motor, a duct leading generally from said fan to the central portion of the end wall of said drum, an electric heater positioned in the duct and through holes in the central portion of the end wall of said drum.

17. A drying apparatus according to claim 16, wherein said means for supplying hot air to the interior of said drum further comprises an air distributing space disposed between said through holes and said duct.

18. A drying apparatus according to claim 1, wherein said drum is disposed eccentrically so as to be closer to one side wall and farther away from the other side wall inside of the cabinet.

19. A drying apparatus according to claim 18, wherein said air path is defined between said side wall which is located farther away from said drum and said peripheral surface of said drum.

* * * * *